US009781505B2

(12) United States Patent
Szczech et al.

(10) Patent No.: US 9,781,505 B2
(45) Date of Patent: Oct. 3, 2017

(54) TOP PORT MICROPHONE APPARATUS

(71) Applicant: Knowles Electronics, LLC, Itasca, IL (US)

(72) Inventors: John Szczech, Bloomingdale, IL (US); Ryan McCall, San Jose, CA (US); Greg Servis, Bloomingdale, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/974,637

(22) Filed: Dec. 18, 2015

(65) Prior Publication Data

US 2016/0205463 A1 Jul. 14, 2016

Related U.S. Application Data

(60) Provisional application No. 62/101,643, filed on Jan. 9, 2015.

(51) Int. Cl.

| | |
|---|---|
| ***H04R 3/00*** | (2006.01) |
| ***H04R 1/22*** | (2006.01) |
| ***H04R 1/08*** | (2006.01) |
| ***H04R 19/04*** | (2006.01) |

(52) U.S. Cl.

CPC ..... *H04R 1/222* (2013.01); *H04R 1/086* (2013.01); *H04R 19/04* (2013.01); *H04R 2201/003* (2013.01); *H04R 2499/11* (2013.01)

(58) Field of Classification Search

CPC ..... H04R 1/222; H04R 1/086; H04R 19/04; H04R 2201/003; H04R 2499/11

See application file for complete search history.

(56) References Cited

U.S. PATENT DOCUMENTS

| | | | | |
|---|---|---|---|---|
| 9,078,063 | B2 * | 7/2015 | Loeppert | H04R 1/04 |
| 9,374,643 | B2 * | 6/2016 | Szczech | H04R 1/086 |
| 2010/0155864 | A1 | 6/2010 | Laming et al. | |
| 2010/0276766 | A1 * | 11/2010 | Tang | B81B 7/0064 257/419 |
| 2011/0165717 | A1 | 7/2011 | Lee et al. | |
| 2012/0177229 | A1 * | 7/2012 | Lorenz | H04R 1/2853 381/111 |
| 2013/0129136 | A1 * | 5/2013 | Harney | H04R 1/342 381/355 |
| 2014/0217521 | A1 | 8/2014 | Johari-Galle et al. | |
| 2014/0248730 | A1 | 9/2014 | Huang et al. | |
| 2014/0294221 | A1 | 10/2014 | Harney et al. | |

OTHER PUBLICATIONS

International Search Report and Written Opinion, PCT/US2015/067385, Knowles Electronics, LLC, 9 pages (Apr. 29, 2016).

* cited by examiner

*Primary Examiner* — Regina N Holder
(74) *Attorney, Agent, or Firm* — Foley & Lardner LLP

(57) ABSTRACT

A microphone includes a microphone base that has a first surface and a second surface. The microphone also includes a microelectromechanical system (MEMS) device coupled to the first surface of the microphone base. The microphone also includes a cover coupled to the first surface of the microphone base, such that the cover divides the first surface into a covered portion where the cover encloses the MEMS device, and a non-covered portion extending away from the cover. The microphone also includes one or more pads on the uncovered portion of the first surface of the base. The microphone also includes a port extending through the base from the first surface to the second surface.

16 Claims, 4 Drawing Sheets

TOP PORT MICROPHONE APPARATUS

CROSS-REFERENCE TO RELATED APPLICATION

This patent claims benefit under 35 U.S.C. §119(e) to U.S. Provisional Application No. 62/101,643 entitled "Top Port Microphone Apparatus" filed Jan. 9, 2015, the content of which is incorporated herein by reference in its entirety.

TECHNICAL FIELD

This application relates to microelectromechanical system (MEMS) microphones and their configurations.

BACKGROUND OF THE INVENTION

Microelectromechanical system (MEMS) microphones are used by today's consumers. For example, these microphones may be used in a variety of different customer electronic devices such as cellular phones or personal computers.

The microphones typically include a MEMS die (with a diaphragm and a back plate). The MEMS die is disposed on a substrate and the substrate is covered by a lid. Sound enters through a hole in the lid or through a hole in the substrate. The sound energy moves the diaphragm. This creates a current which can be further processed by an application specific integrated circuit (ASIC). The processed signal can be made available to electronic devices within the consumer device for further processing.

The communication path between the ASIC and the external electronic devices is made via the base. More specifically, conductive paths are disposed within the base. The ASIC is coupled to these conductive paths on one side (facing the interior of the microphone) of the base, while other pads are disposed on the other side (facing the exterior of the microphone) of the base. The external electronic devices couple to these pads. Unfortunately, the amount of space on a substrate is limited by the size (foot print) of the microphone. Consequently, when many pads (or large pads) are used, little space is left for the port opening. As a result, small port openings may have to be used because of the need for large pads on the bottom of the substrate. Small port openings often result in sub-optimal microphone performance.

These limitations have resulted in some user dissatisfaction with previous approaches.

BRIEF DESCRIPTION OF THE DRAWINGS

For a more complete understanding of the disclosure, reference should be made to the following detailed description and accompanying drawings wherein.

Figure 1:
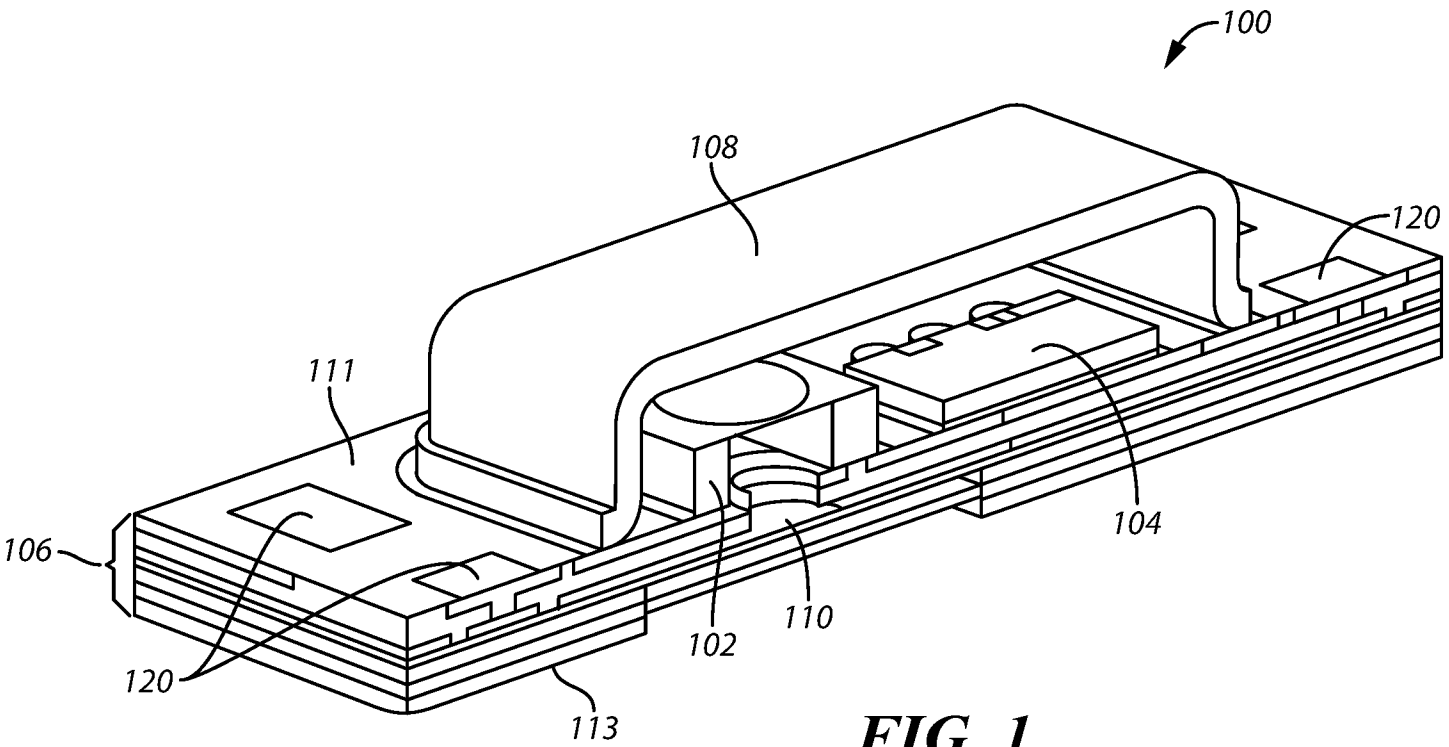
FIG. 1 comprises perspective cutaway according to various embodiments of the present invention.
Figure 4:
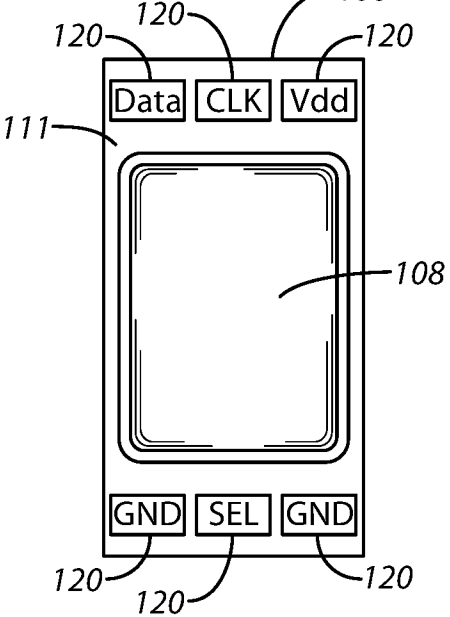
FIG. 4 comprises a bottom view of the microphone of FIG. 1, FIG. 2, and FIG. 3 according to various embodiments of the present invention.
Figure 3:
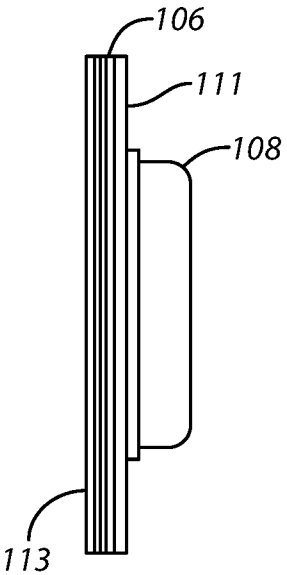
FIG. 3 comprises a side view of the microphone of FIG. 1 and FIG. 2 according to various embodiments of the present invention.
Figure 2:
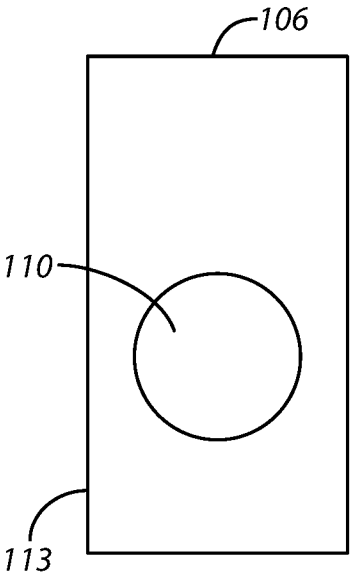
FIG. 2 comprises top a top view of the microphone of FIG. 1 according to various embodiments of the present invention.
Figure 5:
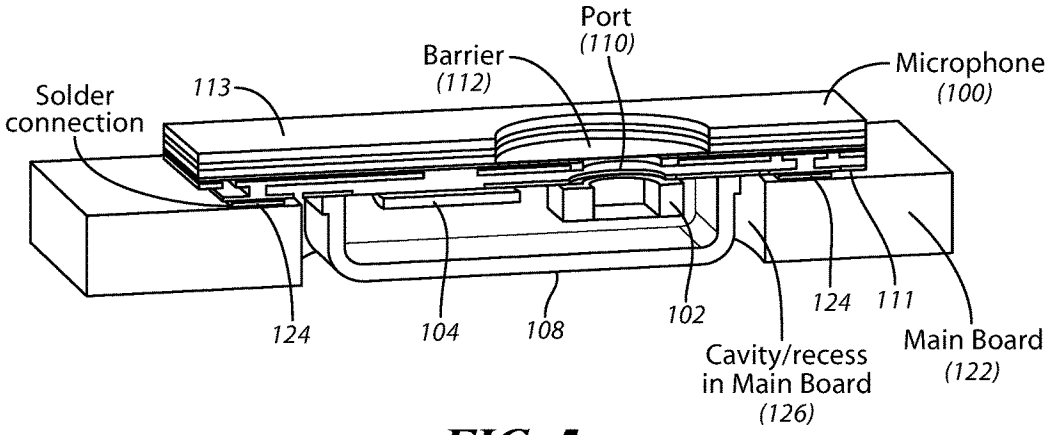
FIG. 5 comprises perspective side view drawing of the microphone of FIG. 1, FIG. 2, FIG. 3, and FIG. 4 as disposed within a customer board according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

In many of these approaches, a top port acoustic device (e.g., microphone) is provided where the external contact pads are on a first surface of the substrate and the port passes through a second and opposite surface of the substrate. The first surface is on one side of the base and the second surface is parallel to the first surface and is on the opposing side of the base. In some aspects, the devices provided herein have a bridge or hat-like configuration. No port passes through the lid when disposed in a customer device.

With devices so-configured, the size of the port opening can be large because the port opening is not on a surface that couples to the customer electronic board. Put another way, the opening or port of the microphone not couple directly to a customer board or customer electronics. In contrast and in previous approaches, the port coupled directly to or was on a surface that directly coupled to a customer board and this limited the size of the opening that could be used through the base.

In many of these examples, the microphones provided herein fit within a recess in the customer board. The opening of the microphones provided herein are on the top of the apparatus making the apparatus a top port device.

Referring now to FIGS. 1-5, one example of a top port microphone that is configured to be placed and used with a customer board is described. The microphone 100 includes a MEMS device 102, an application specific integrated circuit (ASIC) 104, a substrate (or base) 106, a cover (or lid) 108, a port 110, and a barrier 112.

The MEMS device 102 includes a diaphragm and a back plate. The ASIC 104 processes the electrical signal from the MEMS device.

The substrate 106 has a first side or surface 111 and a second side or surface 113. The first surface 111 and the second surface 113 are opposite each other on the substrate 106 and do not intersect. The port 110 extends through the substrate 106 between the first surface 111 and the second surface 113, but opens outwardly to the exterior at the second surface 113. Pads 120 are disposed on the first surface 111 of the substrate 106. The pads 120 may provide connections for voltages (e.g., Vdd), clocks (e.g., clk), data, ground (gnd), and selections (sel). Other examples of connections are possible.

The pads 120 couple to a customer board 122. The customer board 122 may perform any processing function such as a function found in a personal computer or a function that is used in a cellular phone. The cover 108 also couples to the first surface 111. The pads 120 couple to corresponding pads 124 on the customer board 122. The cover fits into a recess or cavity 126 in the customer board 122.

The cover 108 encloses the MEMS device 102 and the ASIC 104. As mentioned, the cover couples to the first surface 111 of the substrate.

The port 110 allows sound energy to pass from the exterior of the microphone to the interior of the microphone. The barrier 112 keeps debris from entering the interior of the microphone, specifically the MEMs diaphragm. In one aspect, the barrier 112 may be a membrane containing pores. The pore size can be modified to tune the acoustic resistance of the audio path to the MEMs device. In one aspect, pores in the membrane may compromise protection against debris making their use appropriate for applications where modification to acoustic response is critical.

In one example of the operation of the system of FIG. 1, sound energy passes into the port 110. The sound energy moves the diaphragm on MEMS device 102, which creates a voltage or current. The voltage or current is transmitted to the ASIC 106, which further processes the signal. The processed signal is send through the substrate 106 to the pads 120. The pads 120 couple to pads 124 of consumer board 122. The consumer board 122 further processes the signal.

It will be appreciated that the size of the port 110 can be large, for example greater than 1 millimeter in diameter, because the port 110 is not on a surface that directly couples to the customer electronic board. In these regards, the second surface 113 does not directly couple to the customer board 122. When disposed together with customer board 122. The opening of the port is disposed on the top of the apparatus (making the apparatus a top port device) even though the port does not extend through the lid 108. Since the port 110 is disposed through second surface 113 that does not include any of the pads 120, the port 110 can practically be any size (within the dimensions of the microphone) but in general port diameters less than 1 millimeter should be avoided to minimize degradation to microphone electroacoustic response. Microphones with smaller height dimensions are also provided.

Figure 6:
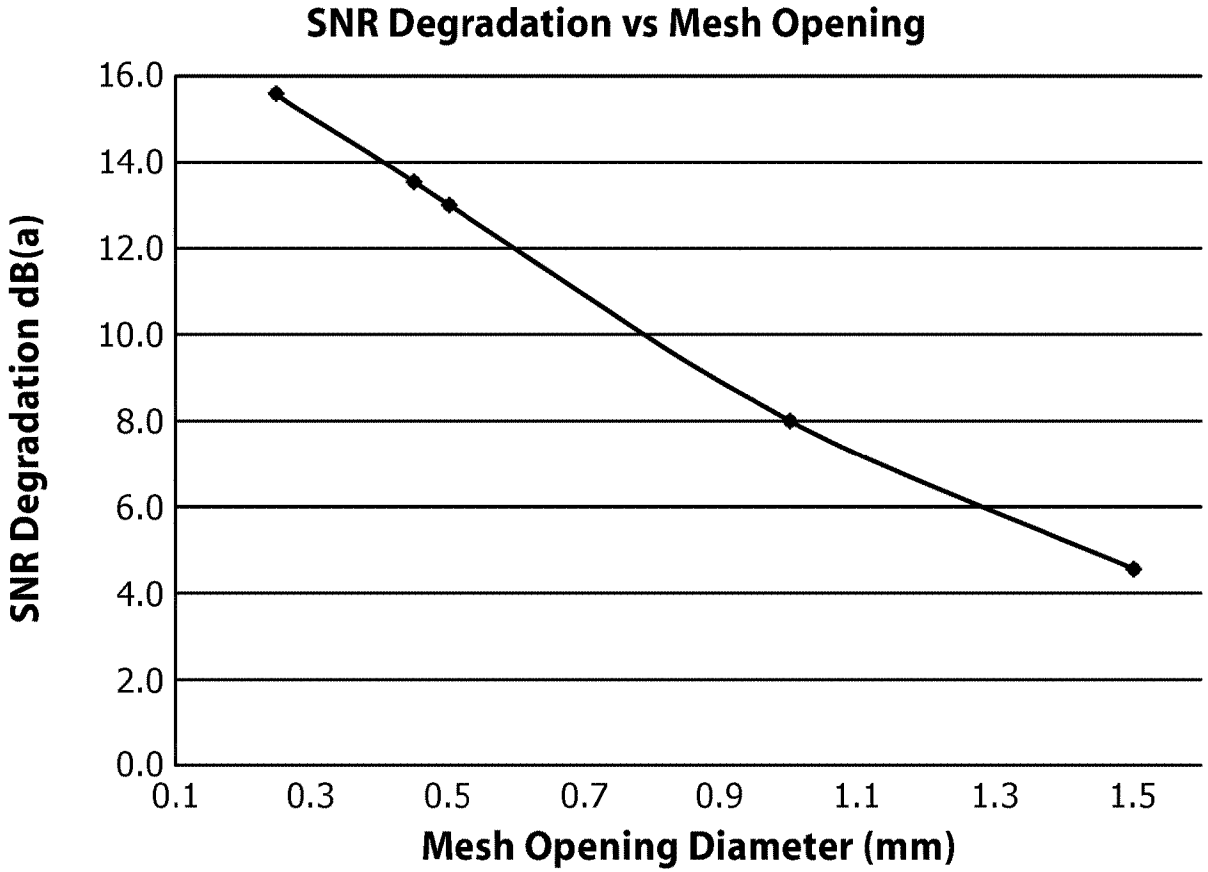
FIG. 6 comprises a graph showing some of the advantages of the present approaches according to various embodiments of the present invention.

Referring now to FIG. 6, one example of some of the advantages of the present approaches are described. The graph shows signal to noise ratio degradation (in dB) on the Y-axis and port or mesh opening diameter on the X-axis. As the port opening size increases, it can be seen that the signal to noise ratio (SNR) degradation decreases. The present approaches in one example provide performance in the bottom right region of the graph of FIG. 6.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A microphone, comprising:

a microphone base, the microphone base having a first surface and a second surface, wherein a first sound port extends through the microphone base from the first surface to the second surface;

a microelectromechanical system (MEMS) device coupled to the first surface of the microphone base and comprising a second sound port disposed under the first sound port;

a barrier disposed within the microphone base and preventing debris from passing through the first sound port, wherein a portion of the first sound port between the second surface and the barrier has a larger diameter than the second sound port;

a cover coupled to the first surface of the microphone base, such that the cover divides the first surface into a covered portion where the cover encloses the MEMS device, and a non-covered portion extending away from the cover; and one or more pads on the uncovered portion of the first surface of the base;

wherein the cover is structured to fit into a recess in a board of a customer device when the one or more pads couple to corresponding pads on the board.

2. The microphone of claim 1, further comprising an integrated circuit disposed on the covered portion of the first surface.

3. The microphone of claim 1, wherein the first surface and the second surface are parallel and do not intersect.

4. The microphone of claim 1, wherein the second surface remains uncoupled to the board of the customer device.

5. The microphone of claim 1, wherein the first sound port has a diameter greater than 1 mm.

6. The microphone of claim 1, wherein the microphone is disposed as a top port device within the customer device.

7. The microphone of claim 1, wherein the barrier includes a membrane with pores, and wherein a size of the pores is configured to tune an acoustic resistance of an audio path to the MEMS device.

8. The microphone of claim 1, wherein the first sound port comprises a second portion disposed between the barrier and the first surface, the second portion having a smaller diameter than the portion of the first sound port between the second surface and the barrier.

9. A device, comprising:

a microphone including:

a microphone base, the microphone base having a first surface and a second surface, wherein a first sound port extends through the microphone base from the first surface to the second surface;

a microelectromechanical system (MEMS) device coupled to the first surface of the microphone base and comprising a second sound port disposed under the first sound port;

a barrier disposed within the microphone base and preventing debris from passing through the first sound port, wherein a portion of the first sound port between the second surface and the barrier has a larger diameter than the second sound port;

a cover coupled to the first surface of the microphone base, such that the cover divides the first surface into a covered portion where the cover encloses the MEMS device, and a non-covered portion extending away from the cover;

one or more pads on the uncovered portion of the first surface of the base; and a board including a recess and one or more pads, wherein the one or more pads of the microphone couple to the one or more pads of the board, and wherein the cover fits into the recess in the board.

10. The device of claim 9, further comprising an integrated circuit disposed on the covered portion of the first surface.

11. The device of claim 9, wherein the first surface and the second surface are parallel and do not intersect.

12. The device of claim 9, wherein the second surface remains uncoupled to the board.

13. The device of claim 9, wherein the first sound port has a diameter greater than 1 mm.

14. The device of claim 13, wherein the barrier includes a membrane with pores, and wherein a size of the pores is configured to tune an acoustic resistance of an audio path to the MEMS device.

15. The device of claim 9, wherein the microphone is disposed as a top port device within the device.

16. The device of claim 9, wherein the first sound port comprises a second portion disposed between the barrier and the first surface, the second portion having a smaller diameter than the portion of the first sound port between the second surface and the barrier.

* * * * *